US006052858A

United States Patent [19]

Drakulic

[11] Patent Number: 6,052,858

[45] Date of Patent: Apr. 25, 2000

[54] TRUCK MOP; MOP FOR CLEANING THE AREA BETWEEN THE CAB AND THE CAP OF A TRUCK

[76] Inventor: Robert Drakulic, 135 Sunrise Dr., Irwin, Pa. 15642

[21] Appl. No.: 09/094,002

[22] Filed: Jun. 9, 1998

[51] Int. Cl.[7] ..... A47L 1/06

[52] U.S. Cl. ..... 15/244.2; 15/118

[58] Field of Search ..... 15/244.1, 244.2, 15/210.1, 118, 209.1

[56] References Cited

U.S. PATENT DOCUMENTS

| | | |
|---|---|---|
| 2,796,617 | 6/1957 | Bradshaw . |
| 2,867,832 | 1/1959 | Hanninen . |
| 3,274,635 | 9/1966 | Myers . |
| 3,491,397 | 1/1970 | Hesener . |
| 3,568,237 | 3/1971 | Rhodes . |
| 4,503,579 | 3/1985 | Nicely . |
| 5,161,279 | 11/1992 | Sager et al. . |
| 5,402,550 | 4/1995 | Lessard . |

*Primary Examiner*—Terrence R. Till
*Assistant Examiner*—Jennifer McNeil
*Attorney, Agent, or Firm*—Nils H. Ljungman & Associates

[57] ABSTRACT

A truck mop for cleaning the difficult to reach areas of a pick-up truck, or similar motor vehicle, such as the area between the cab and the cap of the pick-up truck and a method for using the truck mop. The truck mop includes a plate or support body with sponges secured to either side of the plate. The support body and sponge combination has a sufficiently large surface area to effectively clean the cab and cap of the pick-up truck, and a small enough thickness to allow the device to fit between the cab and the cap of the pick-up truck. The support body is attached to a handle of sufficient length to allow the cab and the cap to be sufficiently cleaned.

2 Claims, 3 Drawing Sheets

TRUCK MOP; MOP FOR CLEANING THE AREA BETWEEN THE CAB AND THE CAP OF A TRUCK

BACKGROUND OF THE INVENTION

1. Field of the Invention

The present invention relates to a cleaning device for the area between the bed and the cab-of a pick-up truck or other motor vehicle.

2. Background Information

The present invention comprises a device used to wash the areas in between the cab of a pick-up truck and the bed of the pick-up truck, or between the cab of a pick-up and the cap on a pick-up bed. These areas can be very difficult to reach to clean because there can be only an inch to an inch and a half of clearance between them.

OBJECT OF THE INVENTION

The object of the present invention is to provide a cleaning device to clean the area between the cab of a pick-up truck and the bed of the pick-up truck, or between the cab of a pick-up truck and a cap on the bed of the pick-up truck, or other such recess in a motor vehicle.

SUMMARY OF THE INVENTION

The present invention teaches that the object of the present invention can be accomplished by a plate or support body, preferably a plastic plate, with a sponge attached to both sides. The sponge can be, for instance, a highly porous material designed to absorb and transfer fluid. The plate and sponges can be connected to a plastic pivoting handle, which, in at least one embodiment, is approximately 36" long, which is ample length to reach between the above areas to be cleaned. This product will also work well on classic trucks and show trucks, and additionally on motorcycles and motorhomes.

The plate and sponge combination has a sufficiently large surface area to effectively clean the cab and cap of the pick-up truck, and a small enough thickness to allow the device to fit between the cab and the cap of the pick-up truck. The support body is attached to a handle of sufficient length to allow the cab and the cap to be sufficiently cleaned.

The above discussed embodiments of the present invention will be described further hereinbelow with reference to the accompanying figures. When the word "invention" is used in this specification, the word "invention" includes "inventions", that is, the plural of "invention". By stating "invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

The attached drawings show an illustration of at least one possible embodiment of the present invention wherein.

DESCRIPTION OF THE PREFERRED EMBODIMENT

Figure 1:
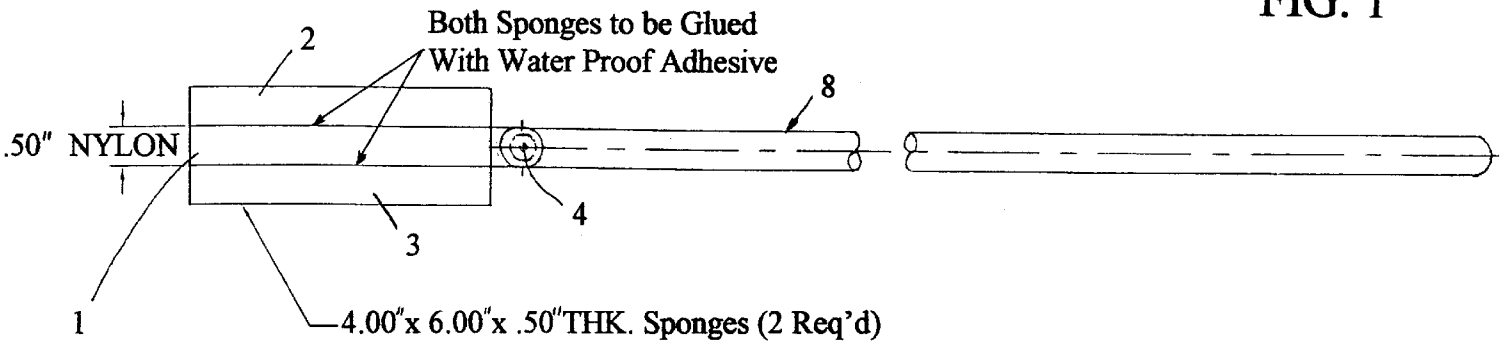
FIG. 1 illustrates a side view of an embodiment of the present invention.

FIG. 1 illustrates a side view of an embodiment of the present invention. In this embodiment, there is a plate 1, which plate 1 can preferably be made of a plastic material, particularly nylon.

In at least one embodiment of the present invention, the plate 1 can have a width of about 6 inches. The plate 1 can also have a length of about 4 inches and a thickness of about 0.5 inch.

Sponges 2, 3 can then be attached to either, or both, face of the plate 1. In at least one embodiment of the present invention, the sponges 2, 3 can each have a size substantially similar to that of the plate. For example, with the plate 1 of dimensions about 4 inches by 6 inches by 0.5 inch, as described above, each of the sponges 2, 3 can also have dimensions of about 4 inches by 6 inches by 0.5 inch. It is also possible, according to embodiments of the present invention, to use sponges 2, 3 which do not have dimensions substantially similar to the dimensions of the plate 1. It is also possible, in accordance with at least one embodiment of the present invention, to use sponges which do not have dimensions which are substantially identical to one another. The sponges 2, 3 can be attached to the plate 1 by, for example, gluing, or by other suitable methods of attachment.

The plate 1 can then be attached to a handle or shaft 8. The handle or shaft 8 can, in at least one embodiment of the present invention, have a length of approximately 32 inches and, in at least one embodiment, can have a diameter of approximately 0.5 inch. The handle 8 can also preferably be made of aluminum or other suitable material.

The handle can be secured to the plate by a pin 4, about which pin 4 the plate 1 can rotate or pivot with respect to the shaft 8. In other embodiments of the present invention, the handle 8 can be non-rotatably attached to, or formed in a single piece with, the plate 1.

Figure 2:
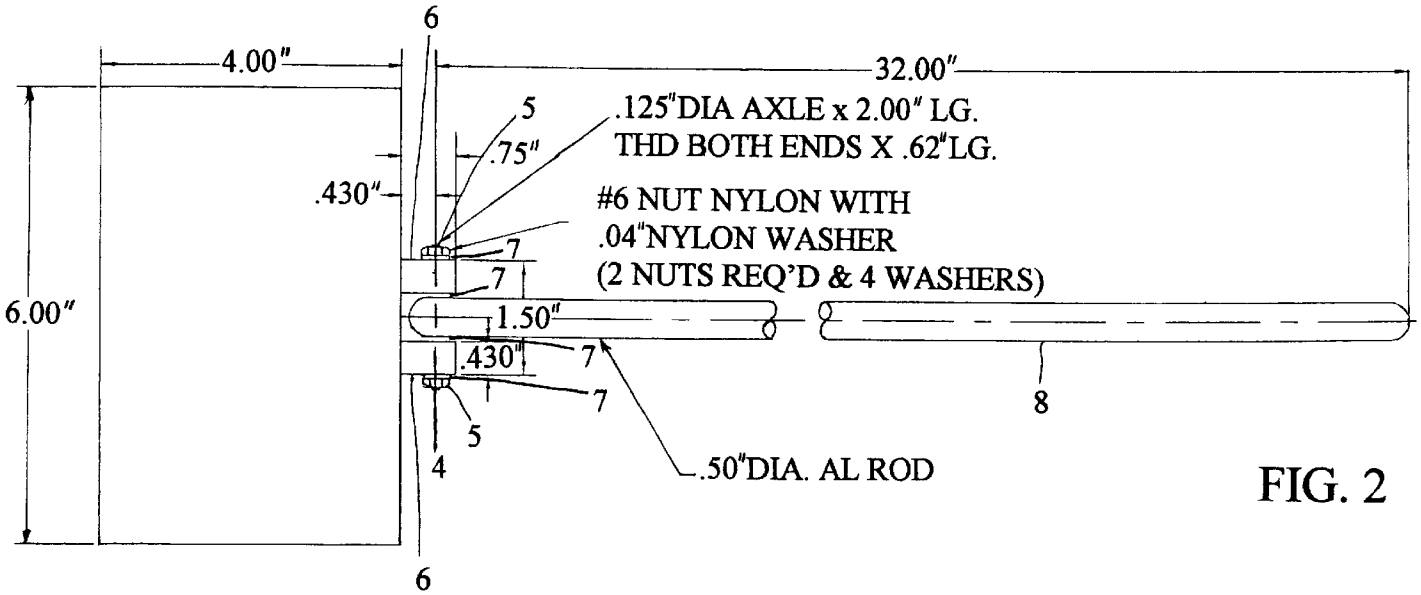
FIG. 2 illustrates a top view of the embodiment shown in FIG. 1.

FIG. 2 illustrates a top view of an embodiment of the present invention as depicted in FIG. 1. The plate 1 can have two projections 6 extending from the plate 1 towards the handle 8. Each projection 6 can have a width of about 0.43 inch, and can project about 0.75 inch from the plate 1. Each of the projections 6, and the handle 8, can have a hole through which the pin 4 can pass, to secure the handle 8 to the plate 1. The centers of the holes in the projections 6 can be, in at least one embodiment of present invention, about 0.43 inch from the plate 1, therefore the center of the pin 4 can also be about 0.43 inch from the plate 1. The pin 4 can have a diameter of about 0.125 inch and a length of about 2 inches.

The pin 4 can be threaded on both ends and, in at least one embodiment, the threaded portion of the pin 4 can be about 0.62 inch on each end of the pin 4. The pin 4 can be rotatably secured to the handle 8 by the use of nuts 5 on either end of the pin 4. In at least one embodiment of the present invention, number 6 nylon nuts can be used to secure the pin 4. Additionally, washers 7 can be place between the handle 8 and the projections 6, and also between projections 7 and the nuts 5. For example, 0.4 inch or similarly sized nylon washers can be used.

Figure 3:
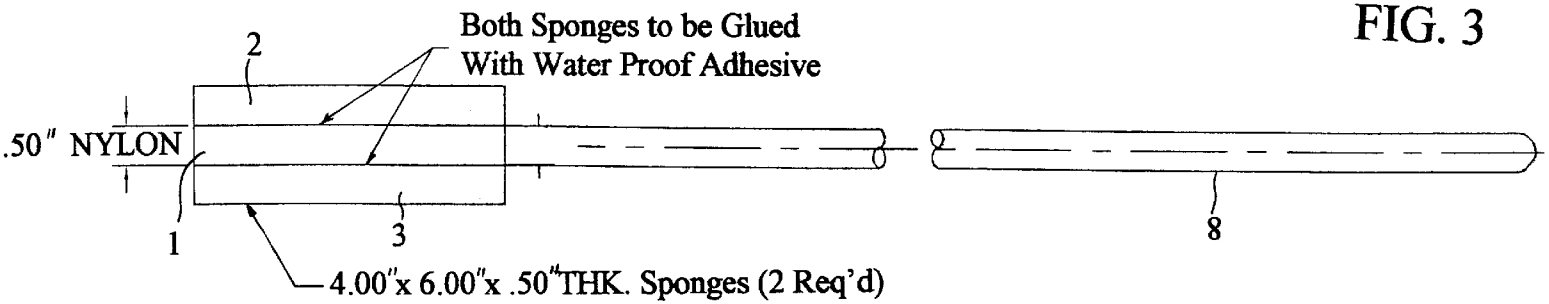
FIG. 3 illustrates a side view of an alternative embodiment of the present invention.
Figure 4:
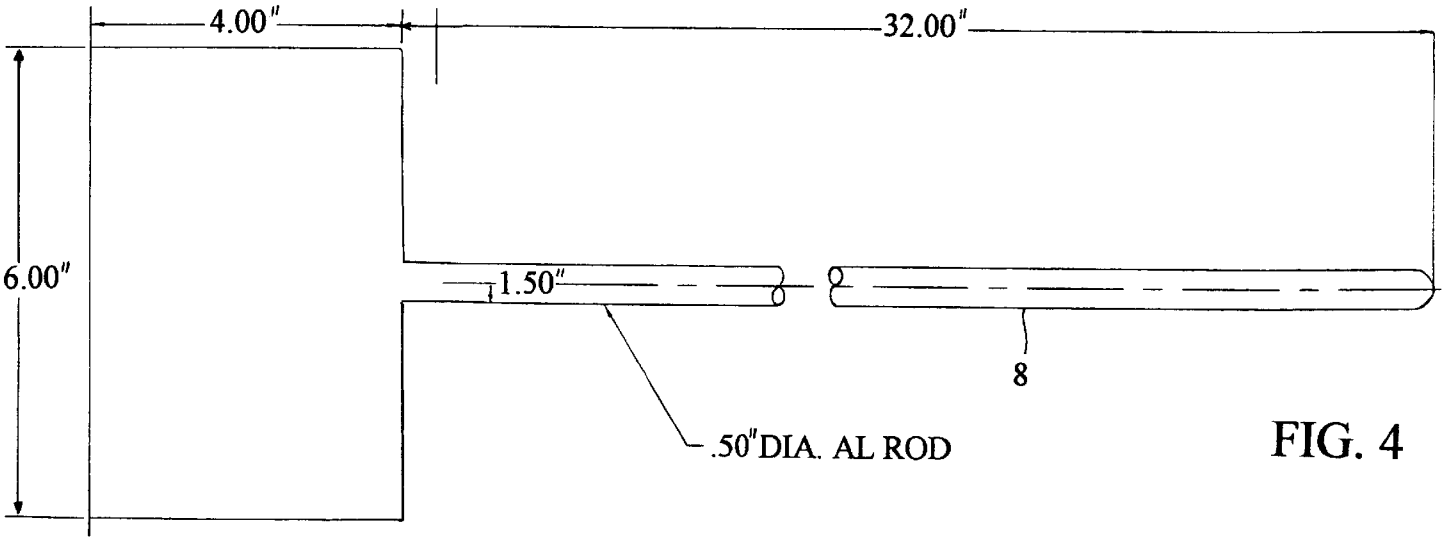
FIG. 4 illustrates a top view of the embodiment shown in FIG. 3.

FIGS. 3 and 4 illustrate an embodiment of the present invention wherein the handle 8 is connected directly to the plate 1. The handle 8, in at least one embodiment, can have a diameter about 0.5 inch and a length of about 32 inches. The plate 1 can have dimensions of about 4 inches by about 6 inches by a thickness of about 0.5 inch. Similarly, the sponges 2, 3 can also have approximate dimensions of 4 inches by 6 inches by 0.5 inch. These dimensions can allow the sponge to fit into the area between the cab of the pick-up and the cap of the pick-up, while still allowing a sufficient cleaning surface for cleaning the area to be cleaned.

Figure 5:
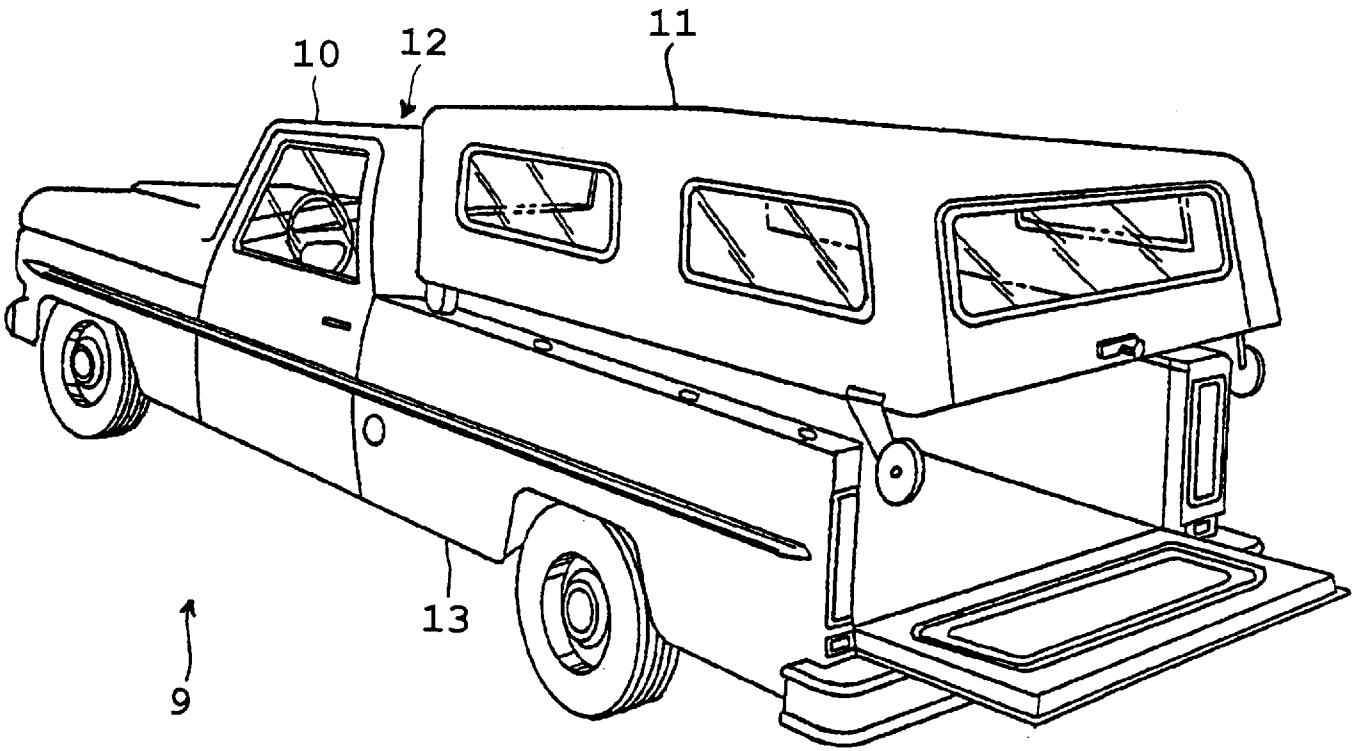
FIG. 5 illustrates a pick-up truck with which at least one embodiment of the invention could be used.

FIG. 5 illustrates a pick-up truck 9 with which the present invention can be used. The pick-up truck 9 has a cab 10 and is fitted with a cap 11 on the bed 13 of the pick-up truck 9. The present invention can be used to clean the crevice or space 12 between the cab 10 and the cap 11.

When cleaning the area between the cab and the cap of the pick-up truck, depending on the space between the cab and the cap, either one of the cab and the cap can be cleaned individually, or, if the crevice between the cab and the cap is sufficiently narrow, both the cab and the cap can be cleaned simultaneously. The present invention can be used alone, or in conjunction with water and/or an appropriate cleaning agent or substance.

One feature of the present invention resides broadly in a device for cleaning the area between the cab and the cap of a pick-up truck with a cap installed, said device comprising a cleaning assembly comprising a support body having first and second sides, said first and second sides opposing one another, two sponges and one of said two sponges being disposed on said first side of said support body and the other of said two sponges being disposed on said second side of said support body, said cleaning assembly being configured to be disposed within the crevice between the cab and the cap of the pick-up truck, said device further comprising a handle having first and second ends, and said first end of said handle being attached to said support body.

Another feature of the present invention resides broadly in said support body comprising two projections, said two projections projecting from said support body towards said handle, each of said projections having a hole disposed therethrough, said first end of said handle being disposed between said two projections, said first end of said handle having a hole disposed therethrough, a pin, said pin being disposed through said holes in said two projections and through said hole in said first end of said handle to rotatably secure said handle to said two projections, and said pin being secured to said two projections and said handle to prevent said handle from separating from said cleaning assembly.

Yet another feature of the present invention resides broadly in a method of cleaning the area between the cab and the bed of a motor vehicle, such as a pick-up truck, with a cleaning tool, the cleaning tool comprising a cleaning assembly comprising a support body having first and second sides, the first and second sides opposing one another, two sponges, one of the two sponges being disposed on the first side of the support body and the other of the two sponges being disposed on the second side of the support body, the cleaning assembly being configured to be disposed within the crevice between the cab and the cap of the pick-up truck, the cleaning tool further comprising a handle having first and second ends, and the first end of the handle being attached to the support body, said method comprising the steps of providing the cleaning tool, disposing the cleaning tool in the area between the cab and the bed of the motor vehicle, and wiping the area to be cleaned with the cleaning assembly of the cleaning tool.

The components disclosed in the various publications, disclosed or incorporated by reference herein, may be used in the embodiments of the present invention, as well as, equivalents thereof.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims. In the claims, means-plus-function clause are intended to cover the structures described herein as performing the recited function and not only structural equivalents but also equivalent structures.

The invention as described hereinabove in the context of the preferred embodiments is not to be taken as limited to all of the provided details thereof, since modifications and variations thereof may be made without departing from the spirit and scope of the invention.

What is claimed is:

1. A cleaning device for cleaning the area between the cab and the cap of a pick-up truck with a cap installed, said device comprising:

a cleaning assembly comprising:

a support body having first and second sides, said first and second sides opposing one another;

two sponges; and one of said two sponges being disposed on said first side of said support body and the other of said two sponges being disposed on said second side of said support body;

said cleaning assembly being configured to be disposed within the crevice between the cab and the cap of the pick-up truck;

a handle having first and second ends;

said first end of said handle being attached to said support body;

said support body comprising two projections;

said two projections projecting from said support body towards said handle;

each of said projections having a hole disposed therethrough;

said first end of said handle being disposed between said two projections;

said first end of said handle having a hole disposed therethrough;

a pin;

said pin being disposed through said holes in said two projections and through said hole in said first end of said handle to pivotably secure said handle to said two projections; and said pin being secured to said two projections and said handle to prevent said handle from separating from said cleaning assembly.

2. A method of cleaning the area between the cab and the bed of a motor vehicle, such as a pick-up truck, with a cleaning tool, the cleaning tool comprising: a cleaning assembly comprising: a support body having first and second sides, the first and second sides opposing one another; two sponges; one of the two sponges being disposed on the first side of the support body and the other of the two sponges being disposed on the second side of the support body; the cleaning assembly being configured to be disposed within the crevice between the cab and the cap of the pick-up truck; the cleaning tool further comprising: a handle having first and second ends; and the first end of the handle being attached to the support body; the support body comprising two projections; the two projections projecting from the support body towards the handle; each of the projections having a hole disposed therethrough; the first end of the handle being disposed between the two projections; the first end of the handle having a hole disposed therethrough; a pin being disposed through the holes in the two projections and through the hole in the first end of the handle to pivotably secure the handle to the two projections; and the pin being secured to the two projections and the handle to prevent the handle from separating from the cleaning assembly; said method comprising the steps of:

providing the cleaning tool;

disposing the cleaning tool in the area between the cab and the bed of the motor vehicle; and wiping the area to be cleaned with the cleaning assembly of the cleaning tool.

* * * * *